United States Patent [19]

Meyer

[11] Patent Number: 5,024,042

[45] Date of Patent: Jun. 18, 1991

[54] BAG FILLING AND CLOSING APPARATUS

[76] Inventor: Hans-H. Meyer, Rotkehlchenstrasse 1, D-4804 Versmold, Fed. Rep. of Germany

[21] Appl. No.: 501,803

[22] Filed: Mar. 30, 1990

[30] Foreign Application Priority Data

Mar. 30, 1989 [DE] Fed. Rep. of Germany ..... 3910208

[51] Int. Cl.[5] ..... B65B 43/14; B65B 5/04

[52] U.S. Cl. ..... 53/168; 53/252; 53/258; 53/571

[58] Field of Search ..... 53/168, 176, 250, 251, 53/252, 255, 258, 261, 570, 571, 572, 573

[56] References Cited

U.S. PATENT DOCUMENTS

| | | | |
|---|---|---|---|
| 3,391,519 | 7/1968 | Keenan, Jr. et al. | 53/572 |
| 3,731,454 | 5/1973 | Crabb | 53/573 X |
| 3,763,627 | 10/1973 | Kupcikevicius et al. | 53/572 |
| 4,242,854 | 1/1981 | Nissen | 53/573 X |
| 4,269,016 | 5/1981 | Kopp et al. | 53/202 X |
| 4,495,751 | 1/1985 | Galbiati | 53/581 X |
| 4,534,155 | 8/1985 | Sawa et al. | 53/573 X |
| 4,616,472 | 10/1986 | Owensby et al. | 53/571 X |
| 4,753,060 | 6/1988 | Furukawa | 53/573 X |

*Primary Examiner*—Robert L. Spruill
*Assistant Examiner*—Daniel B. Moon
*Attorney, Agent, or Firm*—Spencer & Frank

[57] ABSTRACT

A bag filling and closing apparatus includes a filling station (10) in which the material to be filled in (22) is pushed into a prefabricated bag (24). A device (50, 52, 54, 56) is provided for pulling the bags onto the filling machine as is a device for spreading open and holding the bags. Next to the filling station (10), there is disposed at least one supply and/or intake station (12, 14) for bags, each station being equipped with a device (50, 52, 54, 56) for pulling the bags onto the apparatus. A carriage (30) is movable back and forth between the filling station (10) and the supply and intake station (12, 14) carries the spreading and holding device (28, 30, 44, 46) for the bags. The bags can therefore be picked up and spread open in the supply and intake station (12, 14) and can be transferred to the filling station (10) in that position. Preferably, two supply and intake stations are provided on opposite sides of the filling station (10).

6 Claims, 3 Drawing Sheets

BAG FILLING AND CLOSING APPARATUS

BACKGROUND OF THE INVENTION

The invention relates to a bag filling and closing apparatus in which the material to be filled in is inserted into a prefabricated bag in a filling station, the apparatus including a spreading and holding device for the bags to prepare the bags for the filling process, with such device gripping the bags in a position next to the filling station, spreading them open, and moving them into the filling station.

U.S. Pat. No. 4,495,751 discloses a bag filling and closing apparatus which includes a rotatable disc disposed in a vertical plane. The disc is provided with openings which are distributed over its circumference. Around the openings, tubular holding devices are provided which project horizontally from a surface of the disc. A section of a tubular packaging material from a roll is pushed onto the tubular holding devices. The section is severed at one end and sealed. The disc rotates in the manner of a revolver and, in a subsequent station, the merchandise to be packaged is pushed through the respective opening into the interior of the tubular holding device.

Due to the use of a vertically arranged disc which is rotatable about a horizontal axis, this prior art apparatus can be employed only for relatively small packages. Some concerns also arise here regarding the proper operation of the apparatus since numerous moving parts must be accommodated within a small space.

Also known are bag filling devices in which a stack of individual bags is held available in the filling station and the respective upper bag is blown up or opened by vacuum suction. In a second movement, a filling orifice configured as a spreading device enters into the open container and thereafter the material to be filled in, for example a packet of toilet paper, is pushed into the bag. These devices are subject to malfunction since numerous moving elements are accommodated in close confines in the region of the filling station and interfere with one another during their motion sequences so that they often can be moved only consecutively. This leads to delays. Moreover, the material to be filled in must be pushed over a ramp into the respectively uppermost bag of the stack of bags. This results in numerous cases of malfunction (ski jump effect). A further drawback is that, in practice, the number of bags that can be accommodated in the filling position is limited to about 20 bags. This requires frequent replenishment of a stack of bags and thus frequent interruptions of operation.

Another prior art apparatus includes an integrated bag manufacture and assembly system in which the individual bags are brought into the filling station with the aid of a suction belt conveyor immediately upon completion of manufacture and are then opened by blowing in air or by suction. This method is also subject to malfunctions. Due to electrostatic or material specific adhesive forces, the bags cannot always be opened reliably. A synchronous supply is not always ensured.

Additionally, several special constructions are known which, however, have not yet been found to be a reliable and malfunction-free solution for all types of filling processes.

SUMMARY OF THE INVENTION

It is the object of the invention to provide an apparatus of this type which is not much subject to malfunction and permits filling of bags in large numbers and with great efficiency.

This is accomplished by the present invention with an apparatus of the above-mentioned type in that a spreading and holding device is provided on a carriage which moves back and forth between the filling station and a bag supply and/or intake station disposed next to the filling station.

Since thus the supply of bags is held available outside of the filling station, a significantly greater number of bags can be involved than if they are accommodated directly in the filling station. Sufficient space is available for the process of pulling on and spreading open the bags so that reliable operation can be realized. The so-called ski jump effect is no longer present since only the bag to be filled at that moment enters the filling station.

It is also possible to pick up and spread open in the supply and intake station outside the filling station individual bags that were supplied in a roll and have been severed therefrom. This may also be done in that the bag filling apparatus is immediately preceded by a manufacture and assembly system for the bags.

A particularly advantageous embodiment of the invention resides in that supply and/or intake stations for bags are provided on two oppositely disposed sides adjacent to the filling station and the carriage is provided with two juxtaposed spreading and holding devices which, in the end positions of the carriage movement, are alternatingly disposed in one of the supply and/or intake stations and in the filling station. In this embodiment, one bag can be filled while at the same time another bag is pulled up and spread open in on of the supply and intake stations. This mode of operation results in a considerable acceleration of the process sequence in spite of its greater reliability.

In the supply and intake stations, the stacks of bags may be deposited on a support which can be raised vertically and can be adjusted so that the uppermost bag always lies at the same height. Preferably, the bags are held on two parallel overall vertical rods which engage in two holes at the edge of the bags. At their upper ends, the rods are bent in a flat curve in the direction toward the bags. This facilitates removal of the respective upper bag and the bags disposed in the upper region shift slightly relative to one another while still in the stack so that their clinging together due to electrostatic or other material specific characteristics is limited. Depressors lie against the upper end of the rods so as to cooperate with the ends of the rods in a ball and socket configuration; preferably, they are resiliently biased against the rods. This results in reliable separation of the individual bags.

The material to be filled is preferably brought to the filling station in individual packets on an accumulating conveyor and is pushed into the bags by means of a pusher.

The term bag employed in the present connection refers to bag-shaped containers of all types, that is also to sacks, bags made of paper or thin sheets and the like.

DESCRIPTION OF THE PREFERRED EMBODIMENTS

Figure 1:
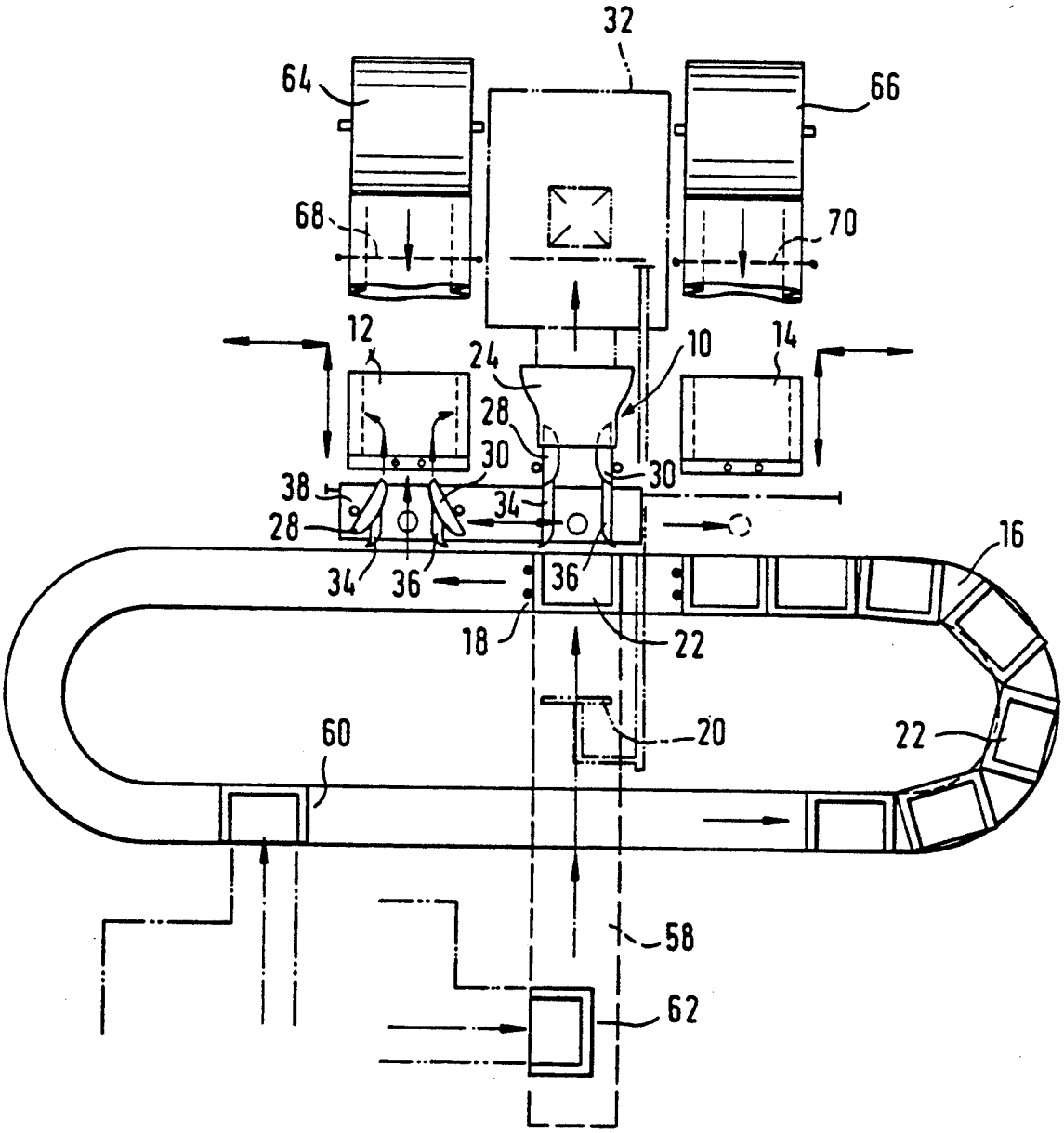
FIG. 1 is a schematic top view of a bag filling and closing system according to the invention.
Figure 2:
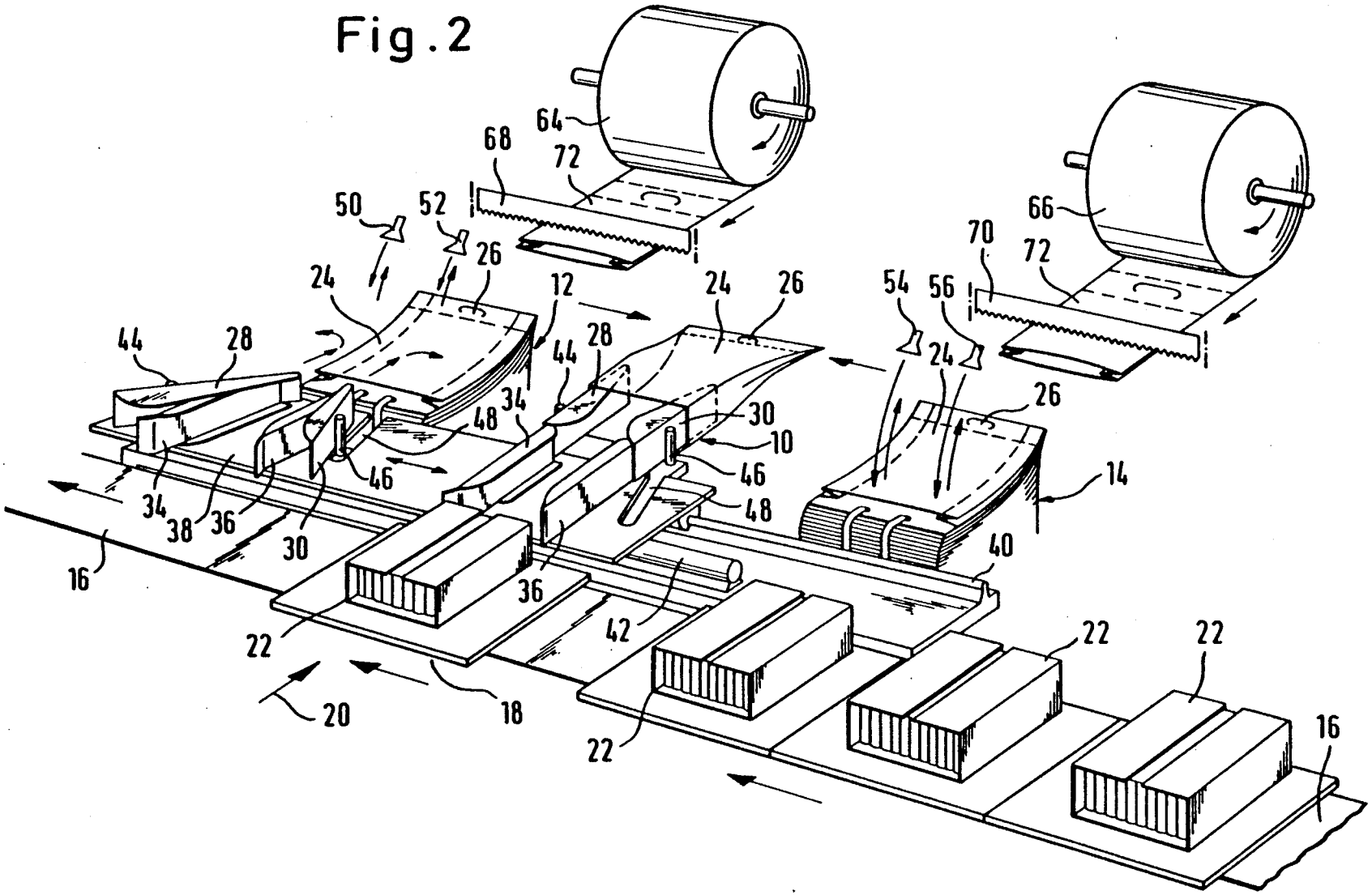
FIG. 2 is a perspective partial view of FIG. 1.

For a description of the bag filling and closing apparatus in its entirety, reference is initially made to FIGS. 1 and 2. The apparatus includes, as its central component, a filling station 10 with which are associated at two oppositely disposed sides bags supplying supply and/or intake stations 12, 14. An endless accumulating conveyor 16 moves along in front of filling station 10 and there has a holding position 18 from which the material 22 to be filled in can be pushed with the aid of a pusher 20 into a waiting bag 24. As is evident, in particular, from FIG. 2, the illustrated example involves a bag which is open at the bottom and has a handle 26, with the bag being open at the bottom, that is opposite to handle 26, during the filling process. The apparatus can of course also be employed with other shapes of bags or sacks. During the filling process, bag 24 is held open by two lateral pivotal spreading jaws 28, 30. After filling of the bag, the latter is advanced to a station 32 (FIG. 1) which is only indicated here and in which the bag is closed and welded shut and then transported away.

In front of spreading jaws 28, 30, there are two lateral guides 34, 36 which laterally guide the material 22 to be filled in during its movement from the accumulating conveyor 16 to spreading jaws 28, 30 and into bag 24. Guides 34, 36 extend parallel to one another and open directly into the spread spreading jaws 28, 30. Guides 34, 36 and spreading jaws 28, 30 are mounted on a carriage 38 which can be pushed back and forth parallel to accumulating conveyor 16. For this purpose, a guide rod 40 and a pneumatic cylinder 42 are provided as indicated in FIG. 2. In a position in front of the left supply and/or intake station 12 in FIGS. 1 and 2, carriage 38 is additionally provided with further guides 34, 36 and spreading jaws 28, 30. As shown by a comparison of the two pairs of guides and jaws, spreading jaws 28, 30 are mounted on vertical pivot axes 44, 46 which are guided in slots 48 in carriage 38 that diverge obliquely in the retraction direction. In order to advance and retract the spreading jaws, a drive mechanism is provided which is not shown here. The movement is necessary to enable spreading jaws 28, 30 to be advanced from the position shown on the left in FIGS. 1 and 2 into a waiting bag.

The displacement path of carriage 38 and the positions of the two pairs of guide and spreading jaws on the carriage are selected in such a manner that they are each disposed alternatingly in front of the left supply and/or intake station 12 and the filling station or in front of the filling station and the right supply and intake station 14. Thus, it is possible to simultaneously fill one bag 24 while picking up a further bag in one of the two supply and intake stations 12, 14.

For this purpose, lowerable suction cups 50, 52 and 54, 56, respectively, are disposed in the two supply and/or intake stations 12, 14, so as to lift the upper bag wall and permit the entrance of the spreading jaws. It is also possible to provide other devices for pulling up the bags, for example air nozzles.

As shown in FIG. 1, instead of the endless accumulating conveyor 16, a linear conveyor 58 may be provided which moves the bags into the holding position 18. The reference numerals 60 and 62 identify the feeding positions of the two conveyors 16, 58.

Due to the use of supply and/or intake stations 12, 14 which are independent of filling station 10, there exists the alternative possibility of using bags for the filling process which are supplied as endless material from a roll and are severed individually. FIGS. 1 and 2 therefore show supply rolls 64, 66 from which individual bags 72 can be cut with the aid of cutting devices 68, 70. Thereafter the bags can be moved into stations 12, 14 with the aid of conveyors (not shown), for example a suction belt conveyor, can be pulled up onto the machine there and spread open as already described.

Since the process of pulling on and spreading open the bags takes place decentrally outside of the filling station 10 and, moreover, two separate supply and/or filling stations 12, 14 exist, the filling process can be accelerated considerably. It is not necessary to accommodate the entire mechanism in the very close confines within filling station 10. The material to be filled in can always be pushed into the bags 24 linearly over a ramp without being moved. The supply of bags to be held ready is significantly larger than if a stack of bags is accommodated directly in the filling station.

Figure 3:
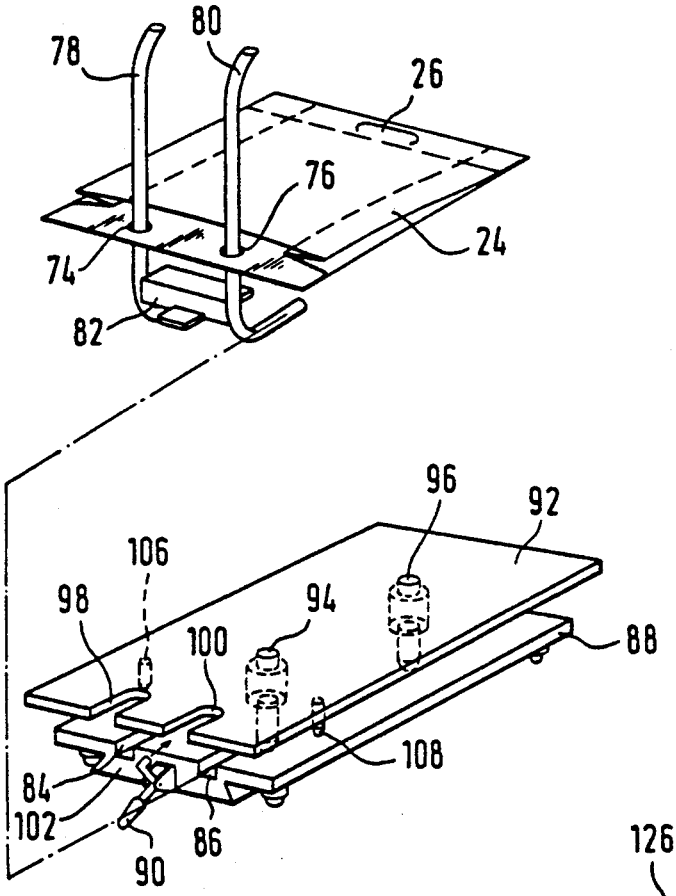
FIG. 3 is a perspective view of the arrangements of the bags in the supply an intake position.
Figure 5:
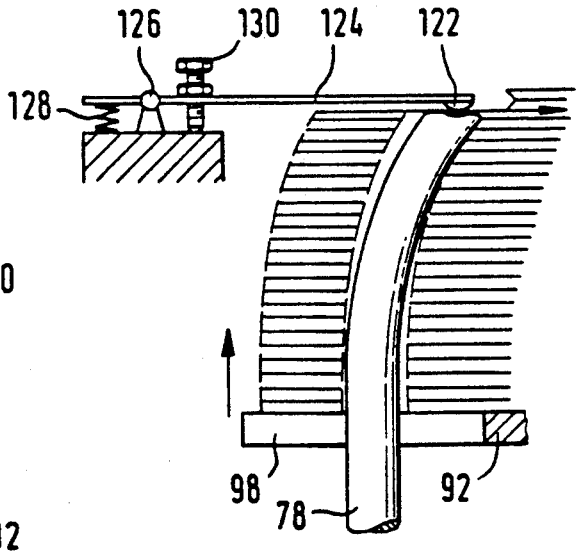
FIG. 5 is a partial sectional view through a stack of bags in the supply and intake station.
Figure 4:
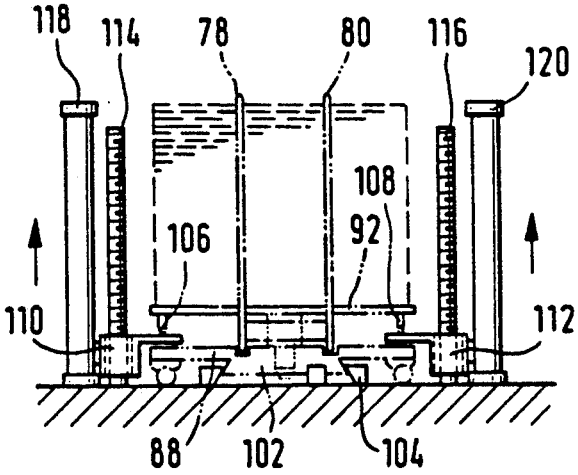
FIG. 4 is a front view of a lifting device next to the elements of FIG. 3.

FIGS. 3 to 5 illustrate the making available of the bags in the supply and/or intake stations. As already indicated in FIGS. 1 and 2, bags 24 are provided with two juxtaposed holes 74, 76 at their bottom edges. These holes make it possible to push the stack of bags onto two, overall vertical parallel rods 78, 80 which are curved in the direction toward the bags in their upper end regions. Rods 78, 80 are connected with one another below the stack of bags by means of a connecting piece 82 and are otherwise bent at a right angle in the direction toward the bags. The nonidentified, angled ends may be pushed into guide grooves 84, 86 at an edge of the overall plate-shaped carriage 88 which is equipped with non-identified rollers for pushing it into stations 12, 14. A hook 90 serves to fix connecting piece 82 and thus rods 78, 80 on the carriage.

Above the carriage, a rectangular, plate-shaped support 92 is supported which forms the actual contact face for the stack of bags. Supporting and guide pins 94, 96 determine the minimum distance between carriage 88 and support 92. Two blind slots 98, 100 entering into an edge of the support permit passage of rods 78, 80.

As indicated in FIG. 3 and also shown in FIG. 4, carriage 88 is provided on its underside with a dovetail guide 102 which enters in stations 12, 14 into a corresponding dovetail guide 104 stationarily attached at the bottom. This fixes the carriage. At stations 12, 14 shown in FIG. 4, support 92, with its downwardly oriented stubs 106, 108 moves onto the top face of lifting members 110, 112 which can be raised and lowered with the aid of vertical spindles 114, 116 and guides 118, 120. In this way, support 92 can be lifted away from the carriage and the upper face of the stack of bags can always be held at a constant level.

FIG. 5 is a partial sectional view of one of rods 78, support 92 and slot 98 in support 92 which receives rod 78. A non-identified stack of bags is indicated on support 92. In its upper region, rod 78 is curved to the right in FIG. 5 so that the bags are shifted relative to one another as can be seen directly in FIG. 2.

The upper end of rod 78 forms a ball socket into which engages a spherical attachment 122 at the underside of a rodshaped depressor 124. The depressor is pivotally mounted in a horizontal axis 126 and permits the setting of a fixed bias for attachment 122 relative to the ball socket. A spring 128 biases depressor 124, and a nut and bolt 130 permit the setting. Depressor 124 and attachment 122 as well as the ball socket of rod 78 act as separating device and prevent uncontrollable discharge of several bags that stick together

I claim:

1. A bag filling and closing apparatus comprising:

a bag filling station for receiving an opened bag to be filled and for filling in a material into the opened bag;

a first bag supplying station disposed on a first side of said bag filling station;

a second bag supplying station disposed on a second side of said bag filling station;

a movable carriage means movable back and forth between said bag filling station and said first and second bag supplying stations;

first opening means disposed on said movable carriage means for receiving and opening a bag when said first opening means is at said first bag supplying station, said first opening means including a first spreading open and holding device for gripping, spreading open, and holding a bag to provide an opened bag; said first opening means holding the opened bag to be filled when said first opening means is at said bag filling station;

second opening means disposed on said movable carriage means for receiving and opening a bag when said second opening means is at said second bag supplying station, said second opening means including a second spreading open and holding device for gripping, spreading open, and holding a bag to provide an opened bag; said second opening means holding the opened bag to be filled when said second opening means is at said bag filling station; and said movable carriage means alternately moving said first opening means between said bag filling station and said first bag supplying station, and said movable carriage means alternately moving said second opening means between said second bag supplying station and said bag filling station.

2. An apparatus according to claim 1, further comprising means disposed at each said first and second bag supplying station for pulling on a bag.

3. An apparatus according to claim 1, further comprising a bag dispensing means disposed at each said first and second bag supplying station for dispensing a bag from a stack of pre-perforated individual bags; said dispensing means including two substantially parallel, vertical rods which in their upper regions are curved and terminate in a substantially flat surface with a socket therein, and resiliently biased depressors terminating in rounded surfaces, and said rounded surfaces contacting side sockets for allowing only one bag from the stack of bags to be dispensed at a time.

4. An apparatus according to claim 3, further comprising a liftable and adjustable support means disposed at each said first and second bag supplying station for supporting and vertically moving the stack of pre-perforated individual bags.

5. An apparatus according to claim 4, further comprising a carriage, said support means being disposed on said carriage, said vertical rods are releasably attached to said carriage, and said support means includes means for defining slots, said slots receiving said vertical rods.

6. An apparatus according to claim 1, further comprising a roll stand disposed at each said first and second bag supplying station for accommodating a roll of prefabricated endless bag material.

* * * * *